US005709109A

United States Patent [19]

Cho

[11] Patent Number: 5,709,109

[45] Date of Patent: Jan. 20, 1998

[54] DRUM TYPE CLOTHES WASHER HAVING A FLUID BALANCING MECHANISM

[75] Inventor: Sung Won Cho, Suwon, Rep. of Korea

[73] Assignee: Samsung Electronics Co., Ltd., Suwon, Rep. of Korea

[21] Appl. No.: 568,698

[22] Filed: Dec. 7, 1995

[30] Foreign Application Priority Data

Dec. 7, 1994 [KR] Rep. of Korea ..... 1994-33409

[51] Int. Cl.[6] ..... D06F 37/22

[52] U.S. Cl. ..... 68/23.2; 74/573 F; 210/144

[58] Field of Search ..... 68/23.2; 210/144; 74/573 F

[56] References Cited

U.S. PATENT DOCUMENTS 2,645,107 7/1953 Smith ..... 68/23.2

2,647,386 8/1953 Keiper ..... 68/23.2

*Primary Examiner*—Philip R. Coe

*Attorney, Agent, or Firm*—Burns, Doane, Swecker & Mathis, L.L.P.

[57] ABSTRACT

A drum-type clothes washing machine includes an outer tub, and an inner tub rotatable relative to the outer tub about a horizontal axis of rotation. The inner tub is tapered, with a larger diameter disposed at one end thereof. A balancer having an inner chamber is disposed on the inner tub at the smaller diameter end. A liquid-absorbing member, such as a sponge, is disposed within the chamber and extends annularly about the axis of rotation. A liquid is contained in the chamber and is disposed at a lower end thereof when the inner tub is at rest. The balancer and sponge rotate together with the inner tub such that a lower portion of the sponge, which is immersed in the liquid, passes through the liquid to cause the liquid to be uniformly distributed throughout the sponge. At low speed rotation (washing mode) the sponge is saturated with liquid to function as a counterbalancing weight. At high speed rotation (spin-drying mode), liquid can exit the sponge under the action of centrifugal force.

11 Claims, 5 Drawing Sheets

DRUM TYPE CLOTHES WASHER HAVING A FLUID BALANCING MECHANISM

BACKGROUND OF THE INVENTION

The invention is related to providing a laundry tub of a drum washing machine, and in particular, to providing a laundry tube of a conical shape including a balancer fluid for suppressing vibrations.

PRIOR ART

A drum washing machine is used for washing or dehydrating (spin-drying) clothes in a manner that a laundry tub coupled to a horizontal rotating shaft pulls laundry up and then drops it down by the centripetal force. It means that the laundry is gathered at the random places on which its weight is exerted, resulting in the unbalanced state of the laundry tub. So, a stress concentration occurs on the horizontal rotating shaft following by the addition of fatigue thereto. Further, the unbalance state during the dehydrating causes the rotating shaft to be subject to overload, thereby producing vibrations. In order to solve these problems, there has been developed a balancer surrounding the washing machine.

Referring to FIG. 6, a conventional drum washing machine A is provided with a balancer, which comprises an outer tub 2 supported in a housing 1 and a laundry tub 6 fixed at one end of a horizontal rotating shaft 4 which is mounted on the rear portion of the outer tub 2. The laundry tub 6 is formed so that a rear portion coupled to a horizontal rotating shaft 4 has a diameter larger than a front portion adjacent to an opening 110. The laundry tub 6 can be used in the washing, dehydrating and rinsing operations, which is typical of a full automatic washing machine.

The housing 1 includes a door 10 openably and closedly mounted on the front portion to accommodate the insertion and removal of laundry. The outer tub 2 stores washing water supplied by means of a feeding device(not shown) in a space formed with the tub 6. Also, weight balancers 12, 14 and 16 are respectively disposed on the upper and front surfaces of the outer tub 2. A shock absorber 18 is mounted on the housing 1 to support the outer tub 2. A motor 20 is attached on the bottom surface of the outer tub 2 to rotate the laundry tub 6 in different speeds characteristic of the washing operation and the dehydrating operation. The motor 20 includes a rotating shaft 22 to one end of which a pulley 24 is fixed. The horizontal rotating shaft 4 includes a pulley 28 mounted at one end of the shaft to be rotated by means of a belt 26 connected to the pulley 24. The horizontal rotating shaft 4 also is supported on a bearing structure 30 to be easily rotated. A supporting member 32 is mounted on the rear portion of the outer tub 2 to support the horizontal rotating shaft 4. A drain device 34 is properly mounted on the bottom surface of the outer tub 2 to discharge water according to the opening/closing control of a controller(not shown). Spring members 36 and 38 are suspended between the upper surface of the outer tub 2 and the housing 1, and a shock absorbing supporter 40 is mounted on the inner portion of the housing 1 to keep a suitable clearance between the housing 1 and the outer tub 2. Thus, the outer tub 2 is elastically supported in the housing 1 by means of springs 38 and 39 and the shock absorber 18.

But, the drum washing machine uses a solid balancer including a heavier mass, so that it can not actively adjust to the changing of a load. Also, an overload happens due to the centrifugal force during the high speed rotation of the laundry tub and is transferred to the supporting member for the horizontal rotating shaft. At that time, it causes the horizontal rotating shaft to be stressed, resulting in inducing vibration of the washing machine while generating the noises. Furthermore, it deteriorates the endurance of the washing machine.

In order to resolve these problems and disadvantages, there is a typical drum washing machine adapting a fluid balancer disclosed in European Patent No. 0390343A2. The washing machine has a problem in that vibration occurs at the lower speed rotation during the washing and rinsing operations, resulting in the application of a larger load to a driving motor. Further, during the dehydrating operation, a resonance band is formed in a predetermined range of entering into a number of the high speed rotations, which increases the vibration of the laundry tub.

Accordingly, an object of the invention is to provide a drum washing machine including a fluid balancer to minimize the occurrence of vibrations not only at the lower speed mode but also at the high speed mode.

Another object of the invention is to provide a drum washing machine including a fluid balancer for responding to the vibrations of each rotation mode, quickly.

SUMMARY OF THE INVENTION

In order to accomplish these objects, a drum washing machine comprises a housing; an outer tub suspended in the housing; a laundry tub movably mounted on the transverse axis in the housing and including a plurality of dehydrating holes; means for feeding washing water to the outer tub and the laundry tub; means for discharging water out of the housing; a driving means for transferring the driving force to the transverse shaft of the laundry tub; and a fluid balancer mounted far away from the transverse shaft on the outer periphery of the laundry tub, in which a fluid absorbent is properly placed in the fluid balancer. Also, the laundry tub has a structure in that one portion for mounting the fluid balancer has a diameter larger than other portion for fixing the transverse shaft.

The fluid absorbent could be arranged in a plurality of longitudinally discontinuous circle shapes coaxially with the horizontal rotating shaft.

BRIEF DESCRIPTION OF THE DRAWINGS

The invention now will be described in detail with reference to the accompanying drawings, in which.

DETAILED DESCRIPTION OF THE INVENTION

Figure 1:
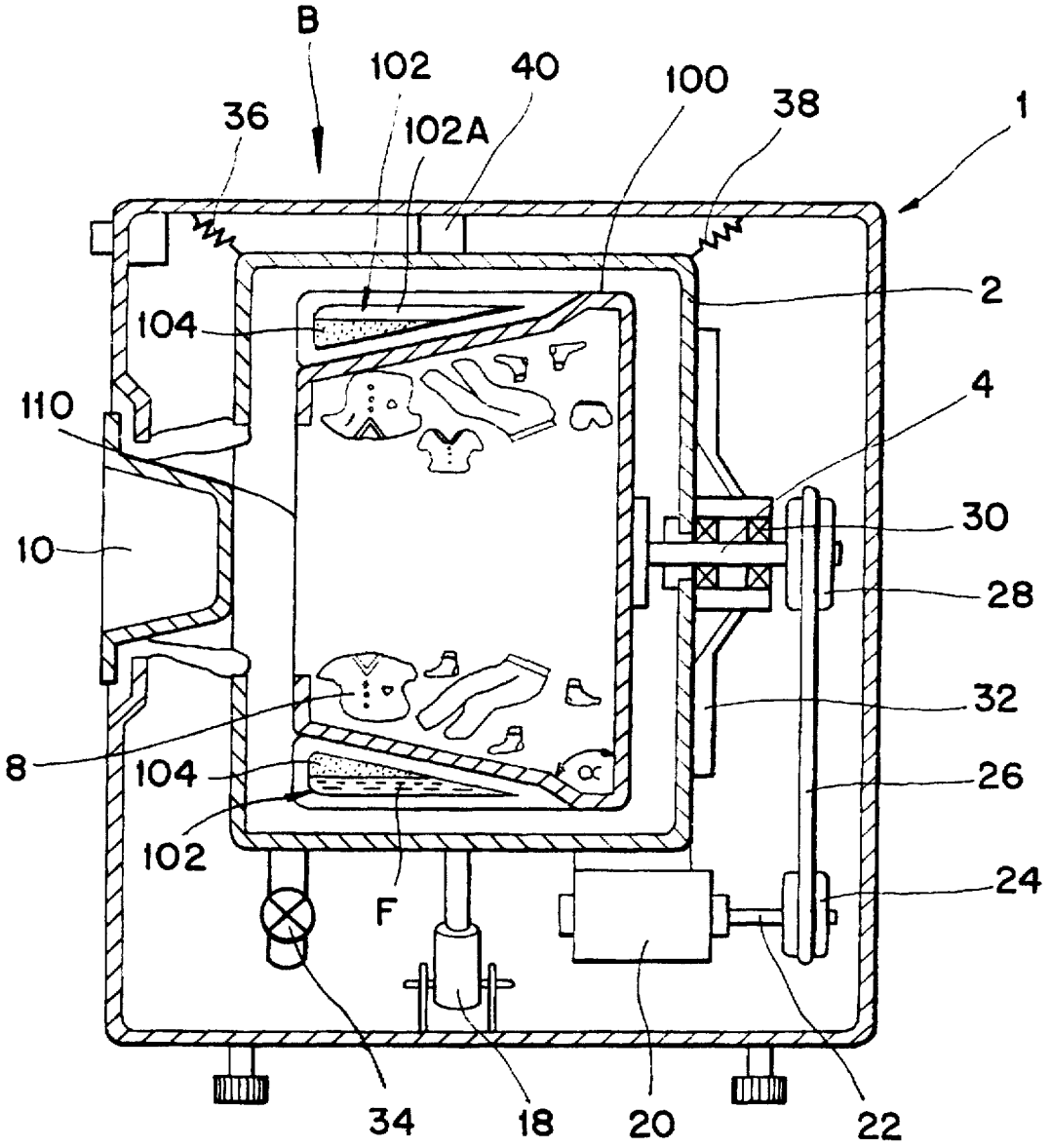
FIG. 1 is a schematic longitudinal cross-sectional view showing a drum washing machine including a fluid balancer during low speed rotation according to the invention.
Figure 2:
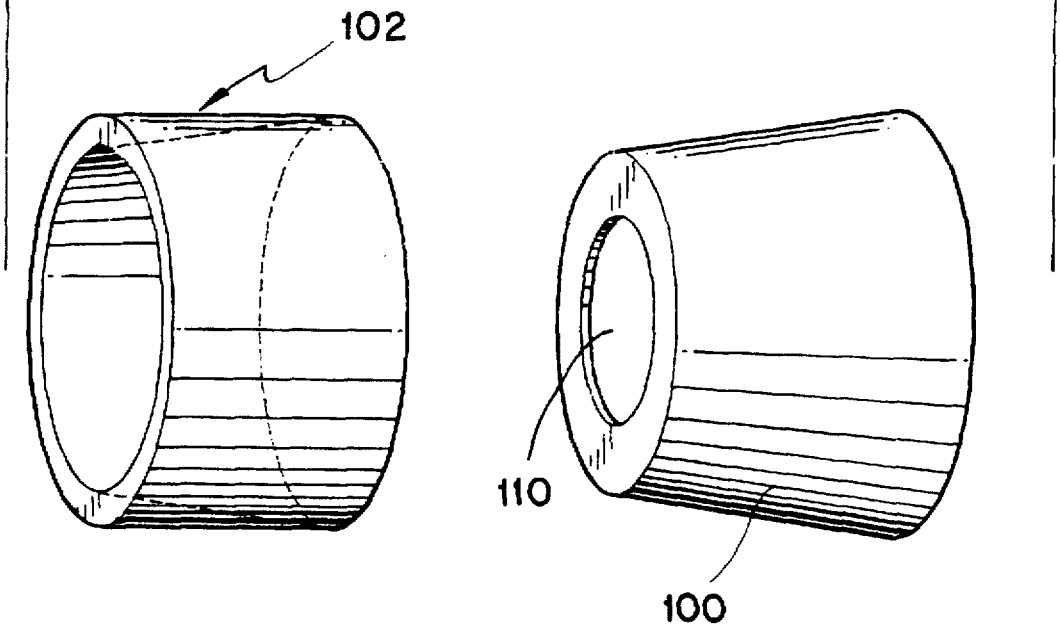
FIG. 2 is an exploded perspective view showing a fluid balancer and a laundry tub of FIG. 1.
Figure 6:
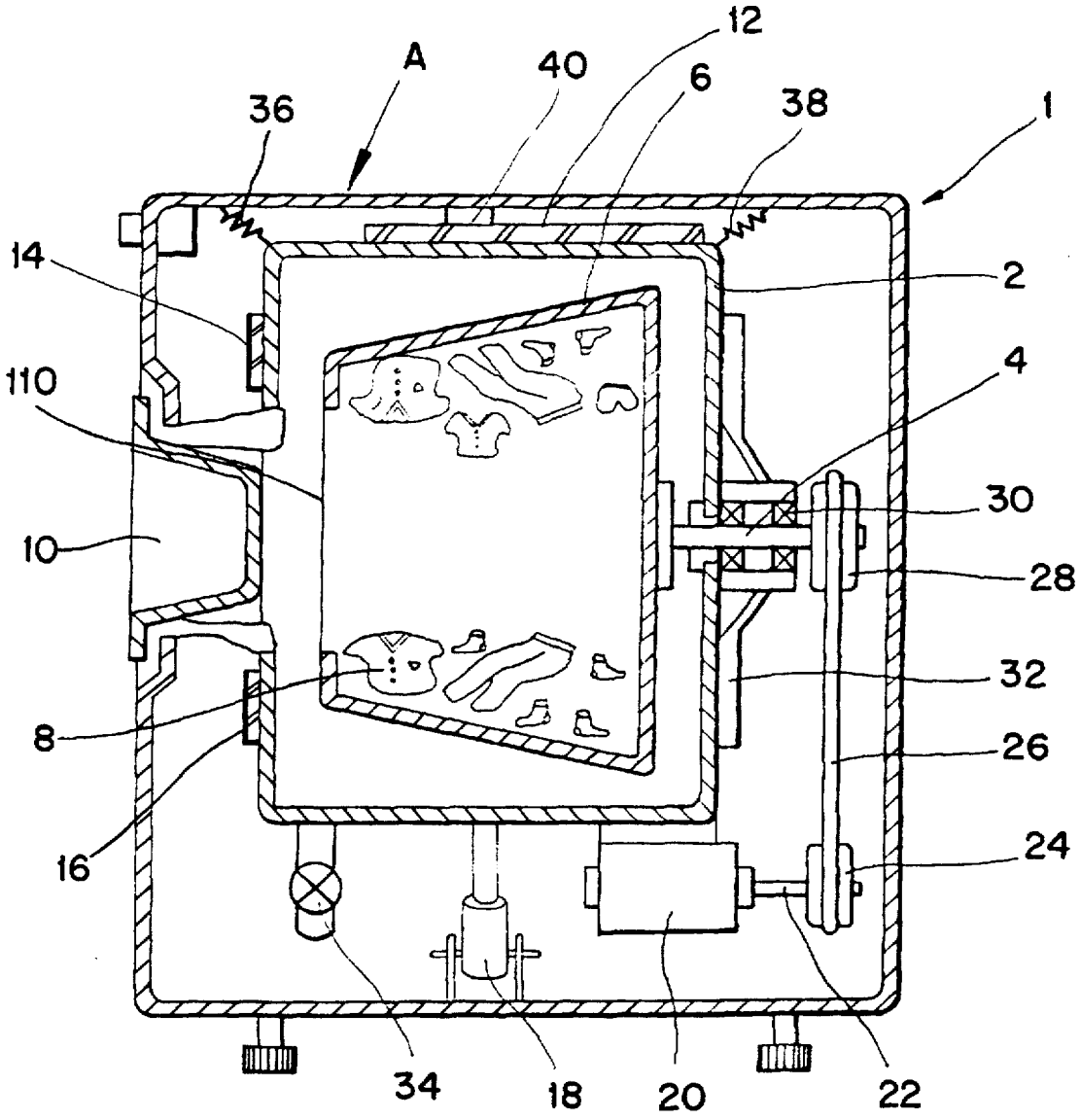
FIG. 6 (PRIOR ART)
FIG. 6 is a schematic cross-sectional view showing a prior art drum washing machine.

Referring to FIG. 1, the same numbers are referenced to the same elements of FIG. 6, the detailed explanation of which is omitted for the purpose of avoiding the repetition of the explanation.

Depicted in FIGS. 1–4 is a dram type washing machine B according to the invention. The machine B includes a laundry tub 100 designed to have a conical structure that is attached to a horizontal rotating shaft 4. The laundry tub 100 includes a rear portion having a diameter larger than a front portion adjacent to an opening 110. It prevents laundry 8 from being gathered near the opening 110. Thus, it is preferable that an angle α formed between the rear and side portions is 80°.

A fluid balancer 102 is configured to surround around the outer periphery of the tub 100 from the front portion of the laundry tub 100 to a predetermined distance. The balancer 102 is coupled by a snap-in method or is an integral structure with the laundry tub 100. The fluid balancer 100 is formed as a right triangle in a transverse cross-section, the height of which is greatest adjacent to the opening 110, while smallest at a location remote from the opening 110 or adjacent to the horizontal rotating shaft 4. The balancer reduces the centrifugal unbalance resulting from a biased weight of the tub, when the laundry 8 contacts the inner surface of the tub 100 while gathering at the rear (righthand) end thereof. In the absence of such balancing, the unbalanced forces would induce vibrations whose maximum magnitude would be disposed adjacent to the opening 110 during the high speed rotation(the dehydrating operation) of the laundry tub 100.

Figure 3:
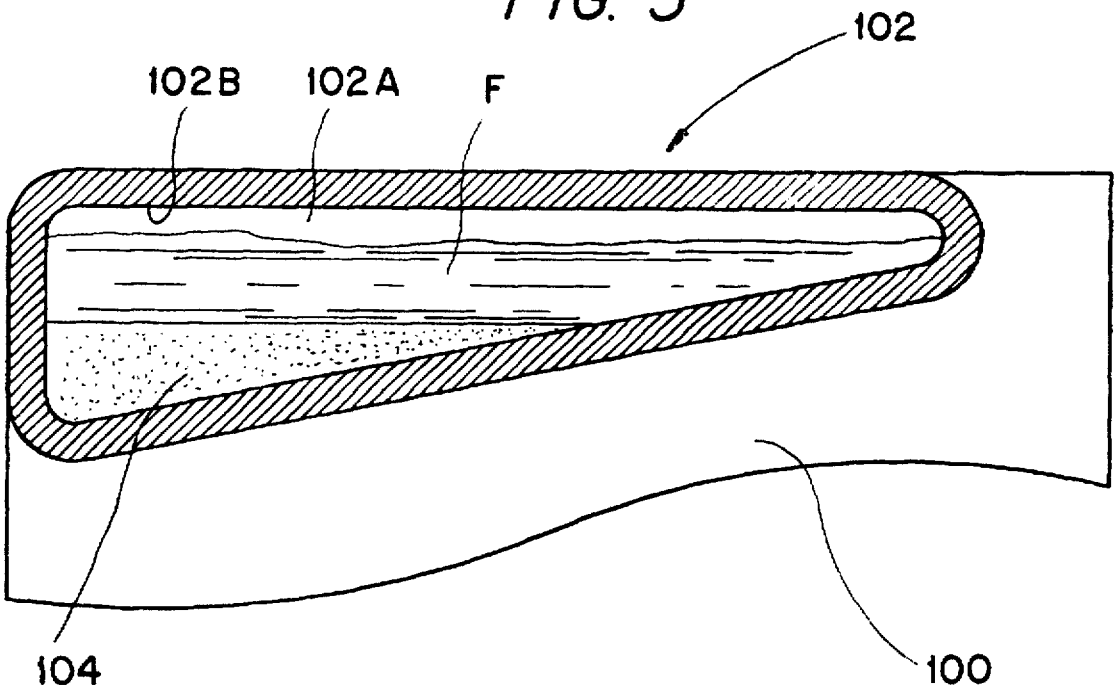
FIG. 3 is a fragmentary cross-sectional view through an upper portion of the fluid balancer during intermediate or high speed rotation.

On the other hand, as shown in FIGS. 1 and 3, an annular fluid absorbing member 104 is disposed in a chamber 102A formed in the fluid balancer 102. Preferably, the absorbing member 104 is a sponge for easily absorbing a fluid F, such as water, disposed in the chamber; the sponge may be any material having a good absorbing property. The absorbing member 104 is thicker adjacent to the opening 110 or the greatest height portion. It can offset the larger magnitude of vibrations induced near the free end or the opening 110 of the laundry tub 110. The absorbing member 104 is integrally configured as an annular ring coaxial with the horizontal rotating shaft 4.

The drum washing machine enables the laundry tub to be operated as follows: when the laundry tub 100 is non-operated, the fluid balancer 102 is stationary to keep fluid F at the lowest portion of the chamber 102A (see FIG. 1).

As the horizontal rotating shaft 4 is rotated at the low washing speed, the laundry tub 100 is rotated at the low speed along with the fluid balancer 102. At that time, a first area of the fluid absorbing member 104 which first area is the lowest portion of the fluid absorbing member 104 moves upwardly along with fluid F absorbed in that first area. Next, a second area of the member 104 following the first area also enters and absorbs fluid and moves up toward the highest portion of the fluid balancer 102. Therefore, the fluid absorbing member 104 passes through fluid to absorb equivalent amounts and become heavier. It enables the laundry tub 100 to be maintained at a uniform weight along the full length thereof, thereby accomplishing the balances of the laundry tub which can now be rotated in a stable state.

During the dehydrating operation, as the horizontal rotating shaft 4 is rotated at the high speed, the laundry tub 100 also is rotated at the high speed. At that time, fluid contained in the absorbing member 104 is drawn out by the centrifugal force and then collected toward the utmost inner periphery

102B of the fluid balancer 102 as shown in FIG. 3. Thus, even though the laundry is biased toward the right end during the rotation of the laundry tub at the high speed, fluid is distributed evenly around the left end to balance the weight of the collected clothes.

Figure 4:
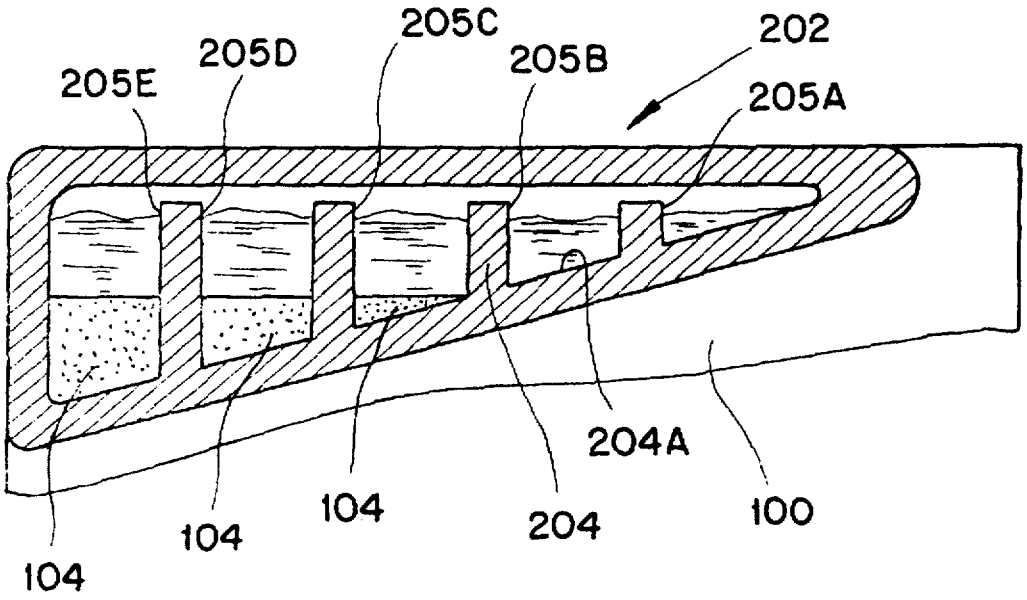
FIG. 4 is a view similar to FIG. 3 showing another embodiment of a fluid balancer including a plurality of partition walls formed therein.

Referring to FIG. 4 illustrating another embodiment of the invention, a fluid balancer 202 is mounted on the outer periphery of the laundry tub 100. A plurality of longitudinally spaced walls 204 are radially extended from the bottom surface 204 of the fluid balancer 202 to form radially outwardly open cells 205A–E which can have the same level of fluid. At the low speed operation, the fluid balancer 202 acts in the same manner as that of FIG. 3, but the higher the rotation speed of the fluid balancer 202 is, the more fluid is flowed over and collected from the shallowest cell 205A adjacent to the horizontal rotating shaft 4 toward the deepest cell 205E adjacent to the opening 110. According to this embodiment, the operation of the fluid balancer 202 is similar to that of a fluid balancer 102 in the first embodiment, the explanation of which is omitted.

Figure 5:
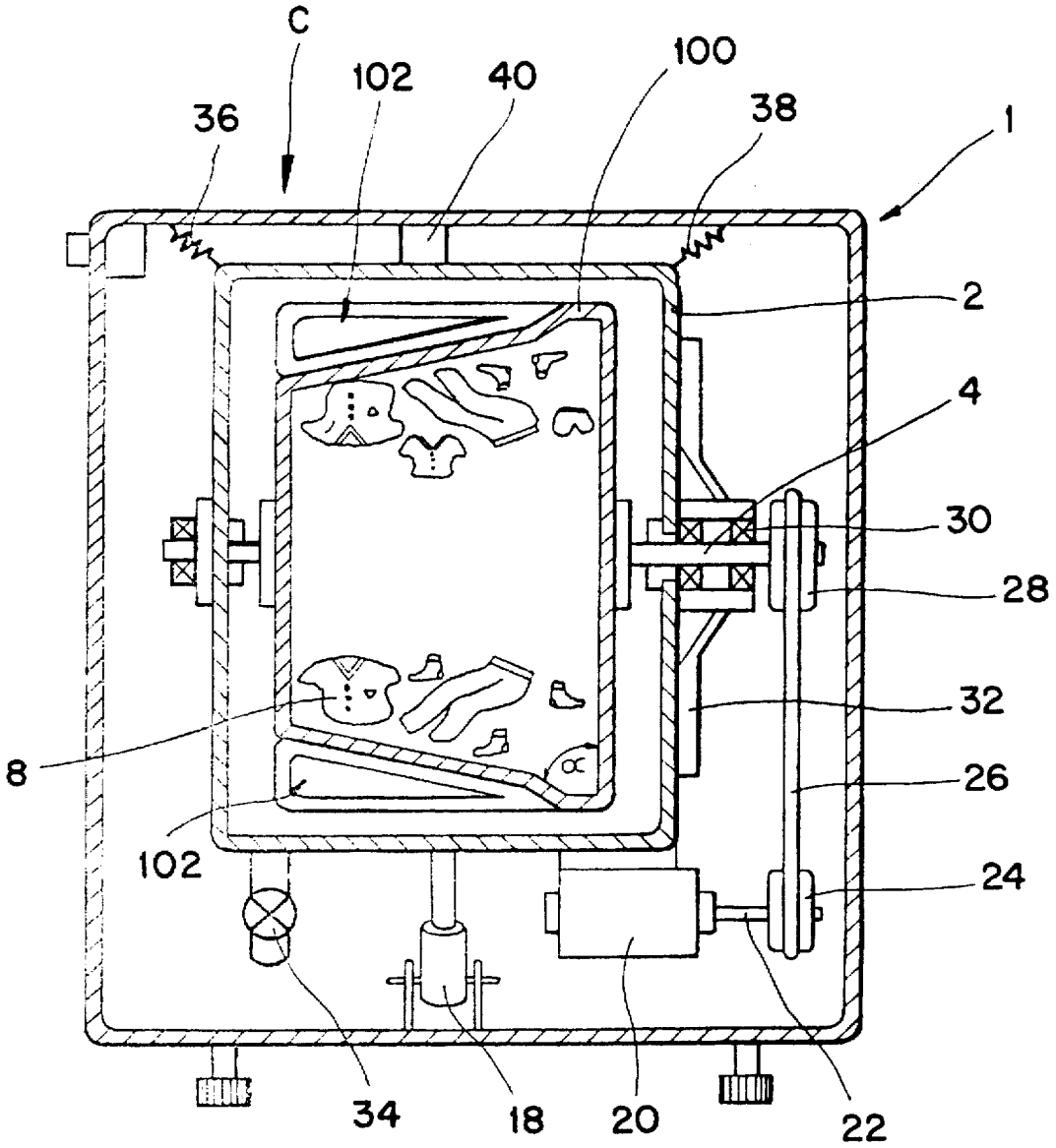
FIG. 5 is a schematic cross-sectional view showing a drum washing machine provided with another embodiment of a laundry tub.

As described above, a drum washing machine is a washing machine of a front loading type for loading and unloading laundry through the side wall of an outer tub, but it is adaptable to a washing machine of a top loading type for loading and unloading through the upper portion of an outer tub as shown in FIG. 5.

As it is apparent from above explanation, the invention comprises a fluid balancer of a right triangle shape mounted around the outer periphery of a laundry tub in a manner that its height adjacent to the open end of the tub is greater than its height adjacent a closed end of the tub. The fluid balancer acts to minimize vibrations generated during the rotation of a laundry tub by balancing the tub.

Also, during the initial or low speed operation, an annular fluid absorbent uniformly contains fluid in itself to maintain a uniform weight throughout the full length of a laundry tub, thereby leading to the stable rotation of the laundry tub.

During the high speed operation, fluid contained in the absorbent is drawn out/moved radially outward by a distance in proportion to the rotation speed, to vary the resulting centrifugal force.

What is claimed is:

1. A clothes washing machine, comprising:

a housing;

an outer tub suspended in the housing;

an inner tub mounted within the outer tub for rotation relative thereto about a substantially horizontal axis of rotation; and a balancing member mounted on the inner tub and for offsetting centrifugal forces acting on the inner tub during rotation thereof; the balancing member forming a chamber having a lower portion in which a liquid is disposed when the inner tub is at rest, a liquid-absorbing member disposed in the chamber, the chamber and liquid absorbing member arranged coaxially relative to the axis of rotation, and the liquid-absorbing member being rotatable about the axis of rotation along with the inner tub.

2. The clothes washing machine according to claim 1 wherein a radial height of the chamber varies along a horizontal length of the balancing member.

3. The clothes washing machine according to claim 2 wherein the inner tub forms a clothes-receiving compartment which is of greater diameter at a first horizontal end thereof than at a second horizontal end thereof, the radial height of the chamber being greatest at an end of the chamber located adjacent the second horizontal end.

4. The clothes washing machine according to claim 3 wherein the inner tub is supported for rotation only at its second end.

5. The clothes washing machine according to claim 3 wherein the chamber is divided into horizontally adjacent cells by horizontally spaced partition walls which project radially outwardly from a radially inner wall of the chamber and terminate short of a radially outer wall of the chamber, a liquid absorbing member being disposed at least in a cell situated closest to the second end.

6. The clothes washing machine according to claim 5 wherein radially outer ends of the partition walls terminate at substantially equal radial distances from the axis of rotation.

7. The clothes washing machine according to claim 2 wherein the radial height of the liquid-absorbing number varies along the longitudinal length of the chamber.

8. The clothes washing machine according to claim 1 wherein the liquid absorbing member is a sponge.

9. The clothes washing machine according to claim 1 wherein the inner tub is suspended in the outer tub by springs.

10. The clothes washing machine according to claim 1 wherein the balancing member is disposed on an outer circumferential surface of the inner tub, the inner tub being tapered from one horizontal end to the other, and the balancing member being tapered from one horizontal end to the other, the tapering of the balancing member being opposite to that of the inner tub such that an outer circumferential surface of a unit comprised of the inner tub and balancing member is of substantially cylindrical shape.

11. The clothes washing machine according to claim 1 wherein a radially outer surface of the liquid-absorbing member is spaced radially inwardly from a radially outer wall of the chamber.

* * * * *